US006779357B1

(12) United States Patent
Fann

(10) Patent No.: US 6,779,357 B1
(45) Date of Patent: Aug. 24, 2004

(54) MULLION SHELF ASSEMBLY

(75) Inventor: Billie Ray Fann, Greenwood, MS (US)

(73) Assignee: Viking Range Corporation, Greenwood, MS (US)

( * ) Notice: Subject to any disclaimer, the term of this patent is extended or adjusted under 35 U.S.C. 154(b) by 0 days.

(21) Appl. No.: 10/361,073

(22) Filed: Feb. 7, 2003

(51) Int. Cl.[7] ..... F25D 21/14; F25D 23/00
(52) U.S. Cl. ..... 62/285; 62/329
(58) Field of Search ..... 62/285, 291, 288, 62/329, 441, 447

(56) References Cited

U.S. PATENT DOCUMENTS

| | | | | |
|---|---|---|---|---|
| 3,933,398 | A | 1/1976 | Haag | 312/214 |
| 3,938,291 | A | 2/1976 | Criswell | 52/731 |
| 3,984,223 | A | 10/1976 | Whistler, Jr. | 62/81 |
| 3,989,329 | A | 11/1976 | Benford | 312/214 |
| 3,999,820 | A | 12/1976 | Haag | 312/214 |
| 4,002,199 | A | 1/1977 | Jacobs | 165/61 |
| 4,033,806 | A | 7/1977 | Lindenschmidt | 156/211 |
| 4,043,624 | A | 8/1977 | Lindenschmidt | 312/214 |
| 4,050,145 | A | 9/1977 | Benford | 29/460 |
| 4,120,550 | A | 10/1978 | Sherburn | 312/296 |
| 4,170,391 | A | 10/1979 | Bottger | 312/214 |
| 4,217,010 | A | 8/1980 | Webb | 312/214 |
| 4,248,489 | A | 2/1981 | Barroero et al. | 312/296 |
| 4,330,310 | A | 5/1982 | Tate, Jr. et al. | 62/275 |
| 4,449,562 | A | 5/1984 | Leivenzon et al. | 160/113 |
| 4,467,618 | A | 8/1984 | Gidseg | 62/187 |
| 4,558,503 | A | 12/1985 | Wilson | 29/446 |
| 4,606,162 | A | 8/1986 | Wendt | 52/282 |
| 4,638,644 | A | 1/1987 | Gidseg | 62/329 |
| 4,820,372 | A | 4/1989 | Gidseg | 156/356 |
| 4,821,399 | A | 4/1989 | Markley et al. | 29/458 |
| 4,852,303 | A | 8/1989 | Rolek | 49/504 |
| 4,914,341 | A | 4/1990 | Weaver et al. | 312/214 |
| 4,941,289 | A | 7/1990 | Rolek | 49/504 |
| 4,944,157 | A | 7/1990 | Jenkins et al. | 62/407 |
| 4,955,676 | A | 9/1990 | Weaver et al. | 312/214 |
| 5,033,182 | A | 7/1991 | Winterheimer et al. | 29/460 |
| 5,255,531 | A | 10/1993 | Williams et al. | 62/277 |
| 5,269,099 | A | 12/1993 | Kennedy et al. | 49/484.1 |
| 5,277,035 | A | 1/1994 | Fristoe et al. | 62/277 |
| 5,349,832 | A | 9/1994 | Johnson et al. | 62/447 |
| 5,425,245 | A | 6/1995 | Martin et al. | 62/187 |
| 5,435,102 | A | 7/1995 | McCarthy | 49/365 |
| 5,475,987 | A | 12/1995 | McGovern | 62/256 |
| 5,558,419 | A | 9/1996 | Dasher et al. | 312/404 |
| 5,584,551 | A | 12/1996 | Jenkins | 312/401 |
| 5,638,694 | A | 6/1997 | Banicevic | 62/277 |
| 5,855,424 | A | 1/1999 | Hamilton et al. | 312/408 |
| 5,890,319 | A | 4/1999 | Haeck et al. | 49/365 |
| 5,897,181 | A | 4/1999 | Avendano et al. | 312/401 |
| 5,899,546 | A | 5/1999 | Avendano et al. | 312/406.2 |
| 5,992,960 | A | 11/1999 | Wolanin | 312/407 |
| 6,019,447 | A | 2/2000 | Jackovin | 312/405 |
| 6,036,293 | A | 3/2000 | Anell et al. | 312/406 |
| 6,036,294 | A | 3/2000 | Banicevic et al. | 312/407 |
| 6,131,338 | A | 10/2000 | Haeck et al. | 49/365 |
| 6,196,011 | B1 | 3/2001 | Bessler | 62/186 |
| 6,360,498 | B1 | 3/2002 | Westphal | 52/204.5 |
| 6,427,387 | B1 | 8/2002 | Hunt | 49/365 |
| 6,428,130 | B1 | 8/2002 | Banicevic et al. | 312/407 |
| 6,460,956 | B1 | 10/2002 | Disbennett et al. | 312/406 |
| 6,463,752 | B2 | 10/2002 | Mandel et al. | 62/382 |

*Primary Examiner*—Chen Wen Jiang
(74) *Attorney, Agent, or Firm*—Womble Carlyle Sandrige & Rice, PLLC

(57) ABSTRACT

A mullion shelf assembly is provided that includes a shelf having translucent upper and lower surfaces and contains an insulative medium that resists heat transfer between the surfaces. The mullion shelf assembly may also include a shelf with an upper surface in fluid communication with a sump. The sump is in fluid communication with a drain that remove condensation from the compartment bounded by the mullion shelf assembly.

29 Claims, 7 Drawing Sheets

MULLION SHELF ASSEMBLY

TECHNICAL FIELD

The present invention is directed generally to refrigerators, and specifically to mullion shelf assemblies for refrigerators.

BACKGROUND

Refrigerators having separate compartments with different temperature zones usually include a mullion separating the compartments. The mullion generally is visible to a user when the refrigerator is open and is composed of an opaque material that is either integrally formed with the walls of the refrigerator or disposed in the refrigerator in such a way as to preclude removal of the mullion without causing some damage to the refrigerator components. Additionally, since mullions generally are integrally formed with the walls of the refrigerator, once a refrigerator is manufactured, the refrigerator's compartments cannot be reconfigured to to alternative sizes and numbers. Each temperature controlled compartment usually includes an evaporator that transfers heat from the compartment to maintain the temperature within the compartment. In compartments in which the temperature is maintained above the freezing point of water, condensation can accumulate on the evaporator and drip down onto the bottom of the compartment. Accumulation of condensation within the compartment can be unsightly and cause articles stored within the compartment to become wet.

Consequently, there is a need for a mullion shelf assembly that serves as the thermal barrier between interior compartments of a refrigerator, allows for reconfiguration of the refrigerator interior, provides visual access into surrounding compartments and/or allows for the removal of condensation from within a refrigerator compartment.

SUMMARY

In one embodiment, the refrigerator and mullion shelf assembly include one or more removable shelves having a sump formed therein. The sump is in fluid communication with a drain that transports condensation away from the shelf. One or more shelves of the mullion shelf assembly have transparent or translucent upper and lower surfaces and an insulative medium that resists heat transfer between the upper and lower surfaces of the shelf. The shelf, therefore, forms a thermal seal with adjacent portions of the refrigerator. The mullion shelf assembly of the present invention may provide a thermal boundary that contributes to the formation of an independently temperature controlled compartment within a refrigerator, such as a wine cooler. The removable shelves of the mullion shelf assembly may be mounted in the refrigerator by fasteners and have foam components that cooperate with the outer edges of the shelves to form thermal seals between the compartments.

The upper and lower surfaces of the shelf are formed by a plate that is transparent or translucent and which is formed of glass, plastic or other suitable material. The plate contains the insulative medium, which may include air, vacuum, polymeric foam or other form of insulation or gas. The sump is formed by a frame which encompasses the plate and is generally disposed below the refrigeration compartment's evaporator where it can receive condensation that falls from the evaporator. A portion of the frame, such as the skirt, bounding the upper surface of the plate prevents liquid spilled on the shelf from flowing off the shelf. The frame may be composed of an upper trim piece and a lower trim piece. The sump is generally formed in the upper trim piece. The lower trim piece may include a light fixture mounting bracket for mounting a light within an adjacent compartment.

In another embodiment, a mullion shelf assembly is comprised of a plurality of shelves disposed within the refrigerator, with at least an upper shelf and a lower shelf. The upper shelf includes an upper sump in fluid and the lower shelf includes a lower sump. Both the upper and lower sumps are in fluid communication with a drain that transports condensate away from the shelves. One or more of the shelves of this mullion shelf assembly includes an insulative medium that resists heat transfer between the upper and lower surfaces of the shelf. The shelves of this mullion shelf assembly may be transparent or translucent and formed of glass so as to provide increased visibility into the adjacent compartments. The upper and lower shelves are removable and may be mounted in various positions within the refrigerator to create compartments of varying size.

When used in a refrigerator, such as a wine cooler, one or more removable shelves of the mullion shelf assembly act as thermal barriers that can be used to create independently controlled temperature zones within the refrigerator. The sump of each shelf may be in fluid communication with the sumps of the other shelves to provide a convenient and efficient route for removing condensation from each mullion shelf within the refrigerator. These and other aspects of the present invention are set forth in greater detail in the detailed description set forth below in the accompanying drawing figures.

DETAILED DESCRIPTION

Figure 2:
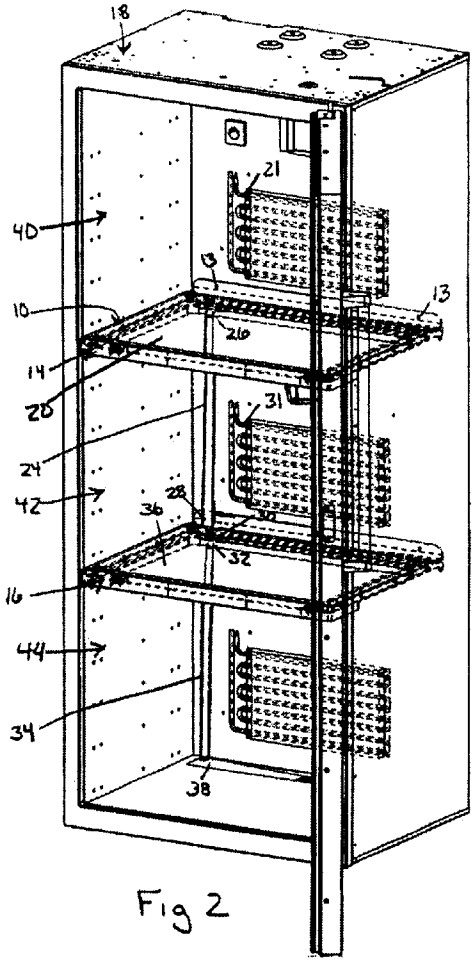
FIG. 2 is a perspective view of the refrigerator and mullion shelf assembly of FIG. 1.
Figure 1:
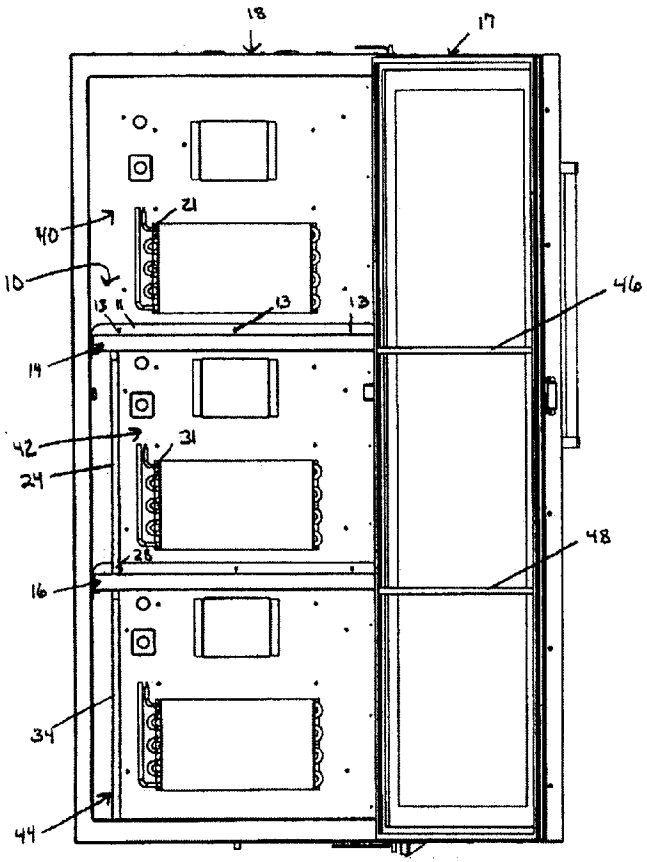
FIG. 1 is a front view of a refrigerator containing a mullion shelf assembly of the present invention.

Referring now in more detail to FIGS. 1–17, in which like numerals refer where appropriate to like parts throughout the several views, FIG. 1 depicts a mullion shelf assembly 10 that includes a plurality of removable shelves mounted within a refrigerator 18. The refrigerator 18 can comprise, but is not limited to, a wine cooler. As shown in FIGS. 1 and 2, the plurality of shelves includes at least an upper shelf 14 and a lower shelf 16, one or both of which may be removable and adjustably mounted at various positions within the refrigerator by the refrigerator manufacturer to form thermally insulated compartments of varying size within the refrigerator 18. The mullion shelf assembly 10 includes one or more shelves having transparent or translucent upper and lower surfaces, which allow the user greater visibility into compartments adjacent to that shelf. The upper shelf 14 includes a first upper surface 20 and an upper sump 22 disposed at the rear of the upper shelf 14 and generally below a first evaporator 21 of a first compartment 40 so that the upper sump 22 catches condensate that drips off of first evaporator 21. Sump 22, itself, is inclined toward sump nozzle 26 positioned at one end of upper sump 22. Condensate that has drained to the upper sump 22 flows from the upper shelf 14 through a first drain line 24, which is attached to upper sump nozzle 26, formed in the lowest point of the upper sump 22. The first upper surface 20 is bounded by a skirt 19 that prevents liquid spilled on the first upper surface 20 from flowing off the shelf.

In the embodiment shown in FIGS. 1 and 2, the upper sump nozzle 26 extends downwardly from the upper shelf 14 toward the lower shelf 16. However, the mullion shelf assembly of the present invention also encompasses drains that do not extend directly between adjacent shelves or extend directly downward from the shelf sump that empties into it. The lower end 28 of the first drain line 24 is aligned adjacent and above the lower sump 30 formed in lower shelf 16, so that liquid exiting the first drain 24 feeds into lower sump 30. Likewise, the lower sump nozzle 32 formed at one end of and the lowest point of the lower sump 30 is attached to a second drain 34. As with the upper sump 22 of the upper shelf 14, the lower sump 30 of the lower shelf 16 is positioned at the rear of the second upper surface 36 of the lower shelf 16 and generally below the second evaporator 31 so as to catch condensate dripping from the surface of the second evaporator 31. Thus, condensation that has dripped off of the second evaporator 31 flows into the lower sump 30 and away from the lower shelf 16 through the second drain 34. Also, any liquid draining through first drain 24 feeds into the lower sump 30 and then flows to second drain 34. The accumulated condensation flowing through the second drain 34 empties into a collection sump 38 that either directs accumulated liquid out of the refrigerator 18 or holds accumulated liquid for later disposal.

The shelves 14 and 16 of the mullion shelf assembly 10 divides the interior refrigerator space into compartments. The first compartment 40 is separated from the second compartment 42 by the upper shelf 14. The upper shelf 14 is mounted in the refrigerator 18 in part by screws 13 disposed in apertures in the rear bracket 11 of the upper shelf 14 and the rear wall 7 of the refrigerator 18. The upper shelf 14 provides a thermal barrier between the first compartment 40 and the second compartment 42 that resists heat transfer between the two compartments by forming a thermal seal with the adjacent walls and door 17 of the refrigerator 18. Consequently, the temperature of the first compartment 40 may be independently controlled and varied from that of the temperature of the second compartment 42. Likewise, the lower shelf 16 is similarly mounted within the refrigerator 18 and provides a thermal barrier and seal between the second compartment 42 and the third compartment 44, to allow these two compartments to be independently temperature-controlled. The upper shelf 14 and the lower shelf 16 both form thermal seals with the upper and lower doors sealing members 46 and 48, respectively, mounted on the inside surface of the door 17 of refrigerator 18. The upper shelf 14 and the lower shelf 16 may be mounted to the sidewalls of the refrigerator by fasteners or fastening systems that may include screws, pins, bolts, catches, brackets and other suitable elements.

Figure 3:
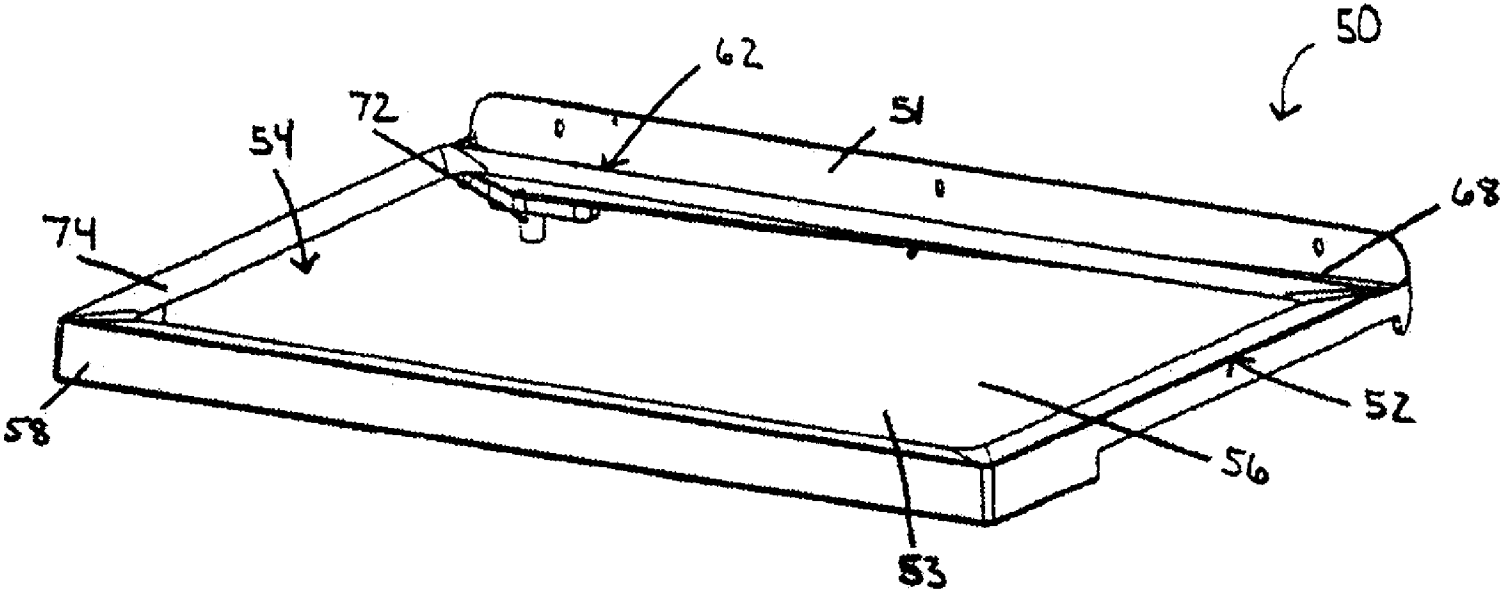
FIG. 3 is a perspective view of a shelf of a mullion shelf assembly of FIG. 1.
Figure 4:
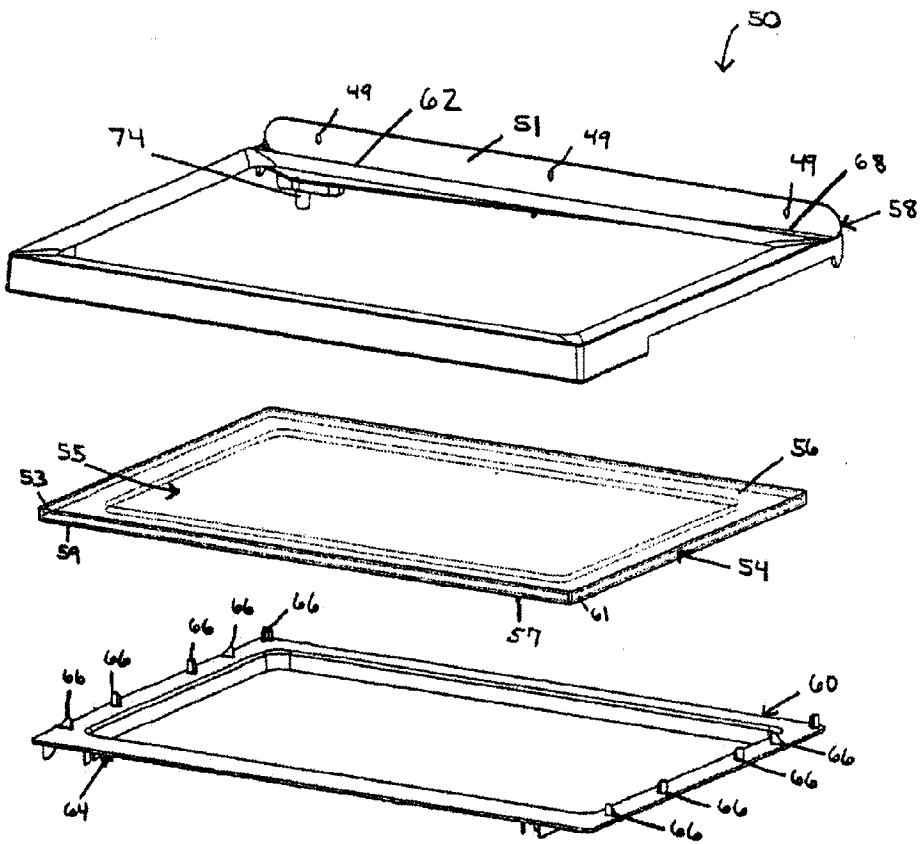
FIG. 4 is an exploded perspective view of the shelf of FIG. 3.
Figure 8:
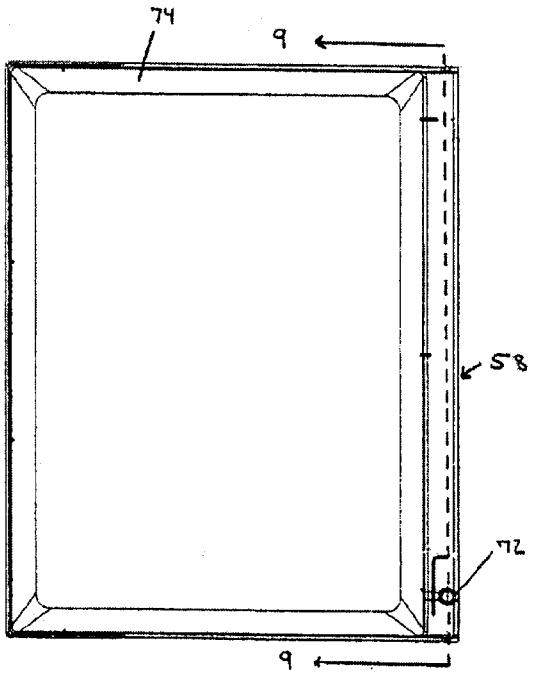
FIG. 8 is a bottom view of the trim piece of FIG. 5.
Figure 7:
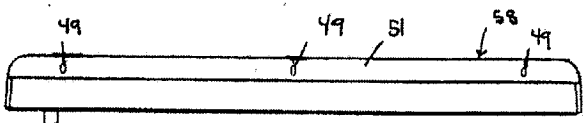
FIG. 7 is a rear view of the upper trim piece of FIG. 5.
Figure 5:
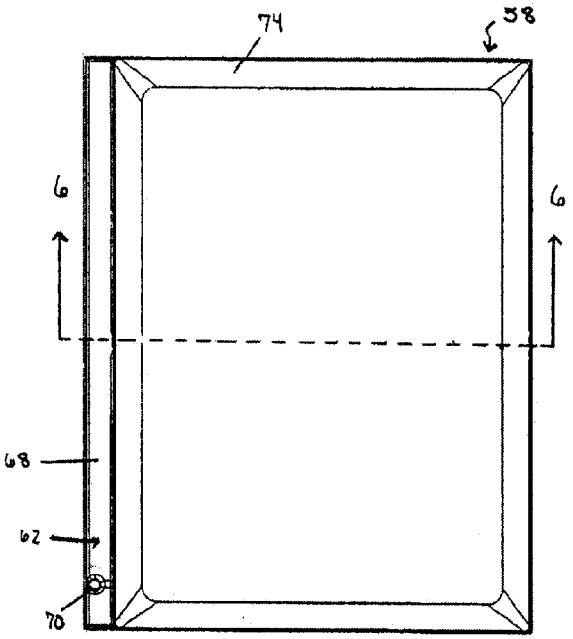
FIG. 5 is a top view of the upper trim piece of the shelf of FIG. 4.

The mullion shelf assembly is shown in FIGS. 3 and 4. The mullion shelf 50 includes a frame 52 that encompasses a plate 54. The upper surface 56 of plate 54 serves as the upper surface of the mullion shelf 50. As shown in FIGS. 4, 15, 16 and 17, the plate 54 is a multi-paned glass plate that contains an insulative medium 55 positioned and sealed between two panes of glass. The upper surface 56 of the shelf 50 is formed on a first pane 53 of glass, while the lower surface 57 is formed on a second pane 59 of glass. The insulative medium 55 may be air, vacuum, other suitable inert gas, polymeric foam and combinations thereof. The insulative medium 55 is disposed between the first pane 53 and the second pane 59, which are connected to each other by adhesive and a glass edge 61. The insulative medium 55 resists the transfer of heat between the first pane and the second pane and, thus, between the upper and lower surfaces of the plate. The plate 54 is supported by the frame 52 which mounts plate 54 within refrigerator 18. The frame 52 includes an upper trim piece 58 and a lower trim piece 60. The upper trim piece 58 includes a rear bracket 51 with a series of apertures 49 therein that may receive fasteners that fasten the mullion shelf 50 to the rear wall of a refrigerator. The plate 54 is held between the upper and lower trim pieces 58 and 60, which are locked together by a series of stops and bosses 66 formed on the trim pieces. A light fixture mounting bracket 64 (FIG. 13) may be formed in or attached to the frame 52 for mounting a light fixture for illuminating the interior compartments of the refrigerator 18.

Figure 6:
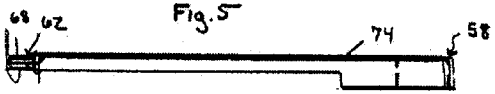
FIG. 6 is a cut-away view of the upper trim piece of FIG. 5 taken along lines 6—6.
Figure 10:
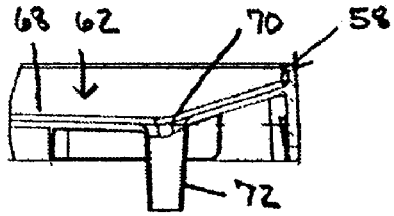
FIG. 10 is an enlarged cut-away view of the portion of the upper trim piece shown in FIG. 9 delineated by circle C.
Figure 9:
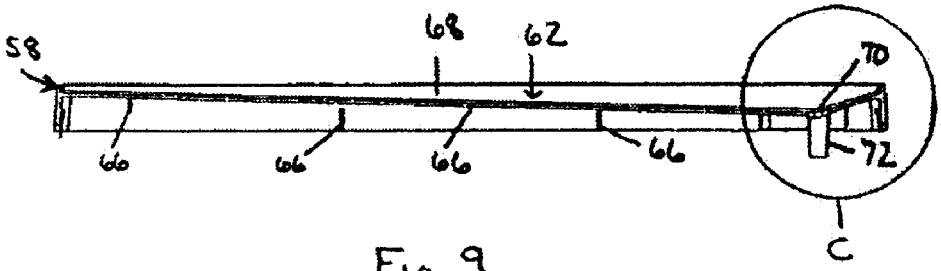
FIG. 9 is a cut-away view of the trim piece of FIG. 8 taken along lines 9—9.
Figure 13:
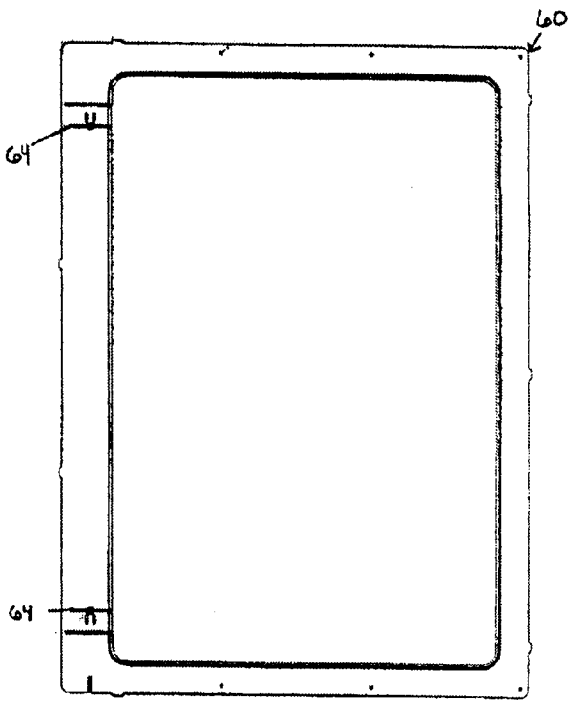
FIG. 13 is a bottom view of the lower trim piece shown in FIG. 4.
Figure 14:
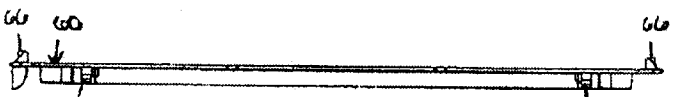
FIG. 14 is a rear view of the lower trim piece of FIG. 4.
Figure 11:
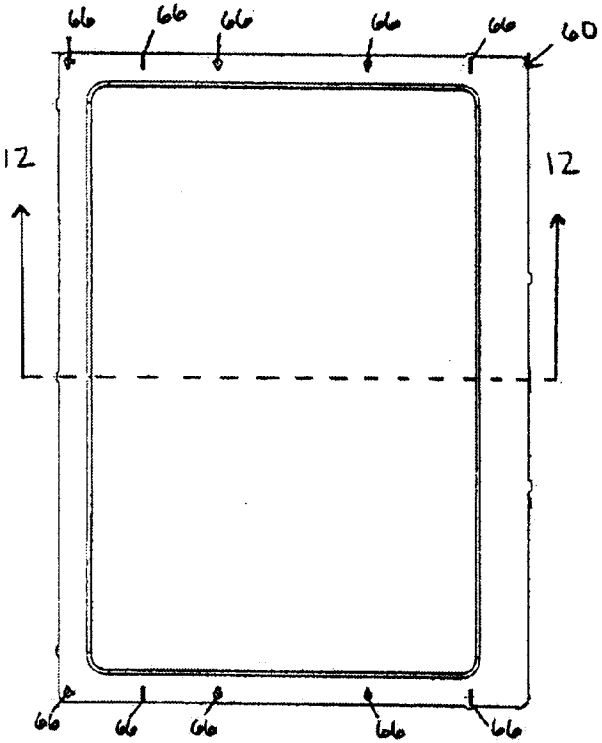
FIG. 11 is a top view of the lower trim piece of the shelf shown in FIG. 4.
Figure 12:
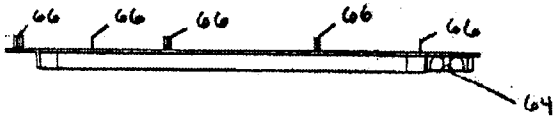
FIG. 12 is a cross-sectional view of the lower trim piece of FIG. 11 taken along line 12—12.
Figure 15:
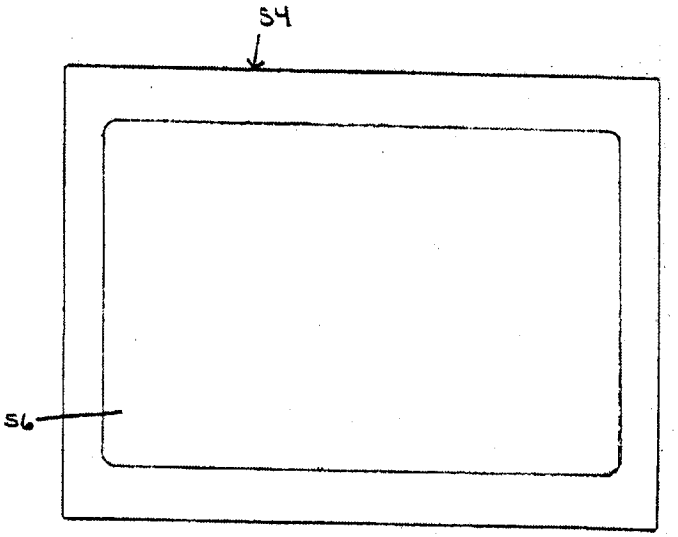
FIG. 15 is a top view of the plate of the shelf of FIG. 4.
Figure 16:
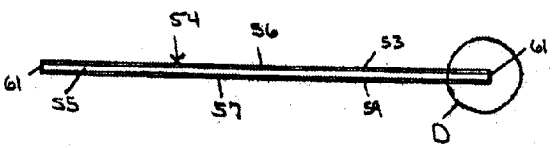
FIG. 16 is a side view of the plate of FIG. 15.
Figure 17:
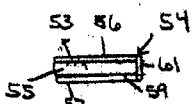
FIG. 17 is a cut-away view of the portion of the plate shown in FIG. 16 delineated by circle D.

The frame 52 also includes a sump 62 (FIG. 6) disposed at the rear of upper surface 56 of plate 54. As shown in FIG. 6, the sump 62 is formed in the upper trim piece 58. The sump 62 includes a channel 68 that slopes to the mouth 70 of nozzle 72. Nozzle 72 extends downwardly from sump 62. In this embodiment, the sump is disposed along the rear section of the mullion shelf 50. The inlet 70 of the nozzle 72 is disposed toward the rear left portion of the mullion shelf 50. The upper trim piece 58 includes a skirt 74 that surrounds the upper surface 56 of plate 54. The skirt 74 reduces or prevents liquid that has spilled on the upper surface 56 of plate 54 from flowing off the mullion shelf 50. The skirt 74 allows liquid to be trapped on the upper surface 56 of the mullion shelf 50, where it then easily removed or cleaned.

The plate 54 may be formed of glass, plastic or other suitable material. Generally, the plate 54 is transparent or translucent to allow a user visual access into adjoining compartments. The frame 52 may be formed of molded plastic, metal or other suitable material. The sides of the frame 52 are generally smooth to allow for the formation of a seal with the walls and door of the refrigerator and/or the sealing members mounted on the walls and door. The frame 50 is generally formed and finished to provide an aesthetic look to the mullion shelf assembly.

It is to be understood that the above embodiments are provided by way of example only and are not to be construed to limit the present invention to only those aspects thereof. The present invention encompasses modifications and alterations made by those of ordinary skill in the art to the disclosed embodiments.

What is claimed is:

1. A mullion shelf assembly for a refrigerator comprising:

a removable shelf having an upper surface and a lower surface spaced from said upper surface, an insulative medium that resists heat transfer positioned between said upper surface and said lower surface of said shelf, wherein said shelf forms a thermal seal with adjacent portions of the refrigerator that contact said shelf;

a sump formed in said shelf; and, a drain in fluid communication with said sump.

2. The mullion shelf assembly of claim 1, wherein said upper surface and said lower surface of said shelf are translucent.

3. The mullion shelf assembly of claim 2, wherein said upper surface and said lower surface of said shelf are formed of glass.

4. The mullion shelf assembly of claim 1, wherein said insulative medium is selected from the group consisting of air, vacuum, polymeric foam, and combinations thereof.

5. The mullion shelf assembly of claim 1, wherein said shelf further comprises a frame encompassing said upper surface.

6. The mullion shelf assembly of claim 5, wherein said sump is formed in said frame.

7. The mullion shelf assembly of claim 5, wherein said frame comprises a light fixture mounting bracket formed thereon.

8. The mullion shelf assembly of claim 1, wherein said sump comprises a nozzle connected to said drain.

9. A mullion shelf assembly for a refrigerator comprising:

a removable shelf having an upper surface formed in a first pane of translucent material and a lower surface formed in a second pane of translucent material, an insulative medium positioned between said first pane and said second pane, wherein said insulative medium resists heat transfer between said upper surface and said lower surface of said shelf, and wherein said shelf forms a thermal seal with portions of the refrigerator adjacent said shelf.

10. The mullion shelf assembly of claim 9, wherein said first pane and said second pane are formed of glass.

11. The mullion shelf assembly of claim 9, wherein said insulative medium is selected from the group consisting of air, polymeric foam, vacuum and combinations thereof.

12. The mullion shelf assembly of claim 9, further comprising a sump formed in said shelf.

13. The mullion shelf assembly of claim 12, further comprising a drain in fluid communication with said sump.

14. The mullion shelf assembly of claim 9, wherein said shelf further comprises a frame encompassing said upper surface.

15. The mullion shelf assembly of claim 14, further comprising a sump formed in said frame.

16. The mullion shelf assembly of claim 15, further comprising a drain in fluid communication with said sump.

17. The mullion shelf assembly of claim 16, wherein said sump comprises a nozzle formed therein and connected to said drain.

18. The mullion shelf assembly of claim 14, wherein said frame comprises a light fixture mounting bracket formed thereon.

19. A mullion shelf assembly for a refrigerator comprising:

plurality of removable shelves disposed within a refrigerator, said plurality of shelves comprising an upper shelf and a lower shelf, said upper shelf comprising a first upper surface and an upper sump, said lower shelf comprising a second upper surface and a lower sump; and, a first drain in fluid communication with said upper sump and said lower sump.

20. The mullion shelf assembly of claim 19, wherein at least one of said plurality of removable shelves comprises a first pane connected to a second pane with an insulative medium disposed between said first pane and said second pane, wherein said insulative medium resists heat transfer between said first pane and said second pane.

21. The mullion shelf assembly of claim 20, wherein said insulative medium is selected from the group consisting of air, vacuum, polymeric foam and combinations thereof.

22. The mullion shelf assembly of claim 20, wherein said first pane and said second pane are translucent.

23. The mullion shelf assembly of claim 22, wherein said first pane and said second pane are formed of glass.

24. The mullion shelf assembly of claim 19, wherein at least one of said plurality of shelves forms a thermal seal with portions of the refrigerator adjacent said shelf.

25. The mullion shelf assembly of claim 19, wherein said first drain comprises a lower end aligned adjacent and above said lower sump of said lower shelf.

26. The mullion shelf assembly of claim 19, wherein said upper shelf comprises a frame in which a light fixture mounting bracket is formed.

27. The mullion shelf assembly of claim 19, further comprising a second drain in fluid communication with said lower sump.

28. The mullion shelf assembly of claim 27, further comprising a collection sump in fluid communication with said second drain.

29. The mullion shelf of claim 28, wherein said collection sump is in fluid communication with said upper sump and said first drain.

* * * * *